US005335631A

United States Patent [19]

Daffos et al.

[11] Patent Number: 5,335,631

[45] Date of Patent: Aug. 9, 1994

[54] STEAM GENERATOR EQUIPPED WITH AN IMPROVED DEFLECTION AND PURGING DEVICE

[75] Inventors: Thierry Daffos, Maurecourt; Christian Valadon, Paris, both of France

[73] Assignee: FRAMATOME, Courbevoie, France

[21] Appl. No.: 46,943

[22] Filed: Apr. 15, 1993

[30] Foreign Application Priority Data

Apr. 15, 1992 [FR] France ..... 92 04642

[51] Int. Cl.[5] ..... F22B 37/48

[52] U.S. Cl. ..... 122/383; 122/382

[58] Field of Search ..... 122/379, 381, 382, 383, 122/388; 165/95

[56] References Cited

U.S. PATENT DOCUMENTS 4,566,406 1/1986 Appleman ..... 122/383 X 4,989,550 2/1991 Sterk ..... 122/383

FOREIGN PATENT DOCUMENTS 2213453 1/1974 France .

2597577 4/1987 France .

WO90/12983 11/1990 PCT Int'l Appl. .

*Primary Examiner*—Edward G. Favors

*Attorney, Agent, or Firm*—Pollock, Vande Sande & Priddy

[57] ABSTRACT

In a steam generator equipping a nuclear power station and having inverted U-Lubes connected to a tube plate or sheet (12) and surrounded by an inner envelope (26) having a lower flow distribution plate (41) in its bottom part, the space (46) known as a waterway between the tube plate (12), the flow distribution plate (41) and the hot and cold branches of the tubes contains a deflection and purging box (44). The latter extends over the entire length of the waterway and in height up to the upper edge of the lower envelope (26). It is provided on its lower face with purging orifices (50) and fulfils both a deflection function and a secondary fluid drainage function in the vicinity of the tube plate (12).

10 Claims, 4 Drawing Sheets

STEAM GENERATOR EQUIPPED WITH AN IMPROVED DEFLECTION AND PURGING DEVICE

FIELD OF THE INVENTION

The present invention relates to a steam generator for use in a pressurized water nuclear reactor and whereof the secondary part is equipped, in the immediate vicinity of the tube sheet or plate, with deflecting and purging device.

BACKGROUND OF THE INVENTION

As illustrated in FR-A-2 333 200, a steam generator equipping a nuclear power station conventionally comprises a vertically axed, outer envelope, whereof the inner space is subdivided into two portions, by a horizontal plate known as a tube plate or sheet. The ends of the tubes of a bundle of inverted U-tubes are fixed to the tube plate and issue below the same respectively into an admission collector or manifold and into a discharge collector or manifold for the water flowing in the primary circuit of the reactor, known as primary water. The water flowing in the secondary circuit of the steam generator, known as secondary water and is a mixture of so-called feed water coming from outside the steam generator and so-called recirculated water from the upper part of the steam generator. The feed water is injected into that part of the steam generator located above the tube plate by a toroidal or semitoroidal supply distributor. The supply distributor is normally placed above an annular recirculation space formed between the outer envelope and an inner envelope covering the tube bundle and having a lower edge is spaced from the tube plate.

In such a steam generator, it is essential to prevent to the greatest possible extent the stagnation of secondary water in certain areas adjacent to the tube plate. Thus, the water may contain mud or slurry, whose deposition on the tube plate around the tubes of the bundle can lead to rapid corrosion of the tubes necessitating their sealing. When an excessive number of steam generator tubes becomes inoperative, it is necessary to replace the entire steam generator. This is obviously undesirable from the standpoint both of cost and the resulting nuclear power station shutdown time. In order to limit these secondary water stagnation areas in the vicinity of the tube plate, distribution plate having an opening in its central portion is positioned in the lower part of the inner envelope and surrounding the tube bundle.

Another problem which arises in the area of the steam generator located immediately above the tube plate relates to the homogenization or equalization of the temperature of the mixture between the feedwater introduced into the generator by its supply manifold and the recirculation water from the water/steam separators located in the upper part of the generator and which drops again through the annular recirculation space. It is also desirable to ensure a good regulation of the flow rates of the mixture before it rises in the inner envelope around the tubes of the bundle.

This problem is generally solved by placing on the tube plate in the space normally known as a waterway and which is formed between said plate, the flow distribution plate and the hot and cold branches of the tubes of the tube lane blocking device.

Moreover, it is also desirable to have a purge immediately above the tube plate, so as to allow removal or sampling of the secondary fluid in this area and to carry out purging mainly in the areas where the secondary fluid flow is at a lower speed, particularly in the center of the tube plate.

In order to fulfil this function, in the waterway there are generally two pipes having holes in the lower part and connected to a purging circuit positioned outside the steam generator. This purging circuit makes it possible to check the chemical concentrations of the secondary fluid, so as to maintain them at acceptable values. IL also makes it possible to sample suspended materials contained in the secondary fluid in the vicinity of the tube plate.

U.S. Pat. No. 4,664,178 describes a steam generator equipped with a purging pipe in the vicinity of the tube plate and having L-shaped deflecting means above the purging pipe, at the base of the inner envelope covering the tube bundle.

Although prior art deflection and purging devices operate in a satisfactory manner , they suffer from the disadvantage of requiring the addition within the steam generator of a relatively large number of separate parts, which complicates the assembly of the generator, increases its price and makes maintenance more difficult.

SUMMARY OF THE INVENTION

The invention specifically relates to a steam generator having inverted U-tubes, with deflection and purging means constituted by a single structure simultaneously fulfilling these two functions.

More specifically, the invention proposes a steam generator comprising a vertically axed, outer envelope, a horizontal tube plate tightly fixed within the outer envelope, a bundle of inverted U-tubes having hot and cold branches with ends fixed to the tube plate and issuing below the latter, respectively in an admission manifold and in a discharge manifold for the primary fluid, an inner envelope covering the tube bundle, whereof a lower edge i s spaced from the tube plate and forming with the outer envelope an annular recirculation space, secondary water feed means issuing into the outer envelope above the tube plate, secondary steam extraction means through the top parts of the inner and outer envelopes and deflection and purging means located in a space formed between the tube plate, the first horizontal plate and the hot and cold branches of the tubes. The deflection and purging means comprise one or more deflection and purging boxes extending over all or part of the length of the space up the vicinity of the inner envelope and extending heightwise to the vicinity of the lower edge of the inner envelope, the box being spaced from the tube plate and having purging orifices facing the latter.

Preferably, the deflection and purging box extends in height up to an intermediate level between the flow distribution plate and the lower edge of the inner envelope. Moreover , inspection holes formed in the latter and in the outer envelope of the steam generator issue immediately above the longitudinal ends of the deflection and purging box.

The deflection and purging box according to the invention is connected to draining means by at least one draining tube issuing at at least one of the ends of the box in the bottom of the latter .

In a preferred embodiment of the invention, at least two drainage tubes issue laterally into a central part of the deflection and purging box on either side of the latter, which has orifices facing the tube plate. This feature makes it possible to improve the efficiency of the drainage in the central part of the steam generator positioned immediately above the tube plate.

According to a preferred embodiment of the invention, the deflection and purging box has a bottom forming a longitudinal recovery slot into which issue the purging orifices.

As a function of the particular case, the deflection and purging box can have a uniform cross-section over the entire length thereof or can instead be evolutive.

The invention is applicable to any tube plate steam generator type and in particular to those of the "boiler" type or those of the "axial preheater" type .

More specifically, in the case of steam generators of the "boiler" type with no separation between the hot and cold branches of the tubes, the deflection and purging box rests on the tube plate via support menders between which the purging orifices are formed.

In steam generators of the "axial preheater" type, a vertical separating plate is placed between the hot and cold branches of the tubes of the bundle and connected to the tube plate. In this case, the deflection and purging box comprises two parts on either side of the separating plate and supported by the latter.

BRIEF DESCRIPTION OF THE DRAWINGS

With reference to the attached drawings.

DESCRIPTION OF THE PREFERRED EMBODIMENT

Figure 1:
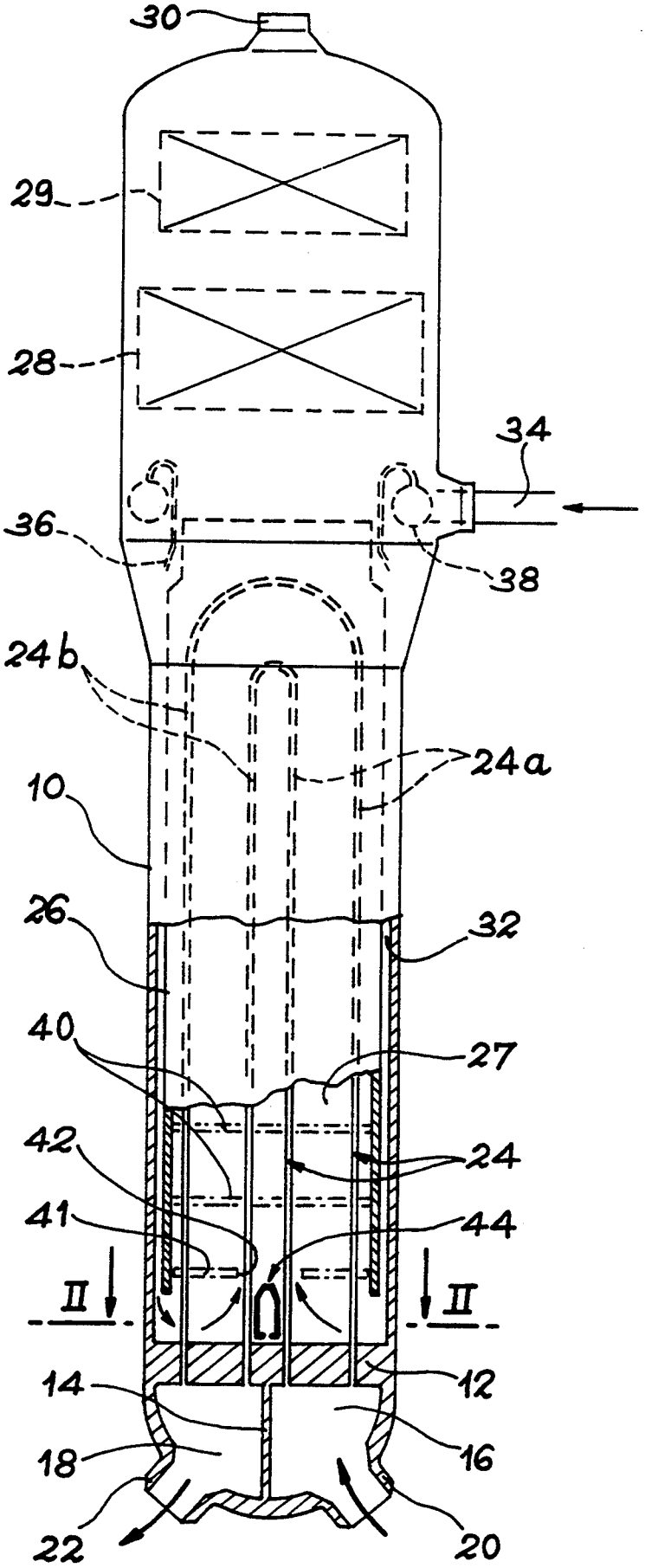
FIG. 1 is a side view schematically illustrating in partly vertical section a boiler-type steam generator according to the invention.

FIG. 1 schematically shows a boiler-type steam generator illustrating a first embodiment of the invention. This steam generator ensures the heat transfer between the primary water circuit and the secondary water/-steam circuit of a pressurized water nuclear reactor.

FIG. 1 shows the vertically axed, outer envelope of revolution 10 of the steam generator. The envelope 10 defines a closed inner space subdivided into a primary lower area and a secondary upper area by a horizontal tube plate 12 tightly connected to the envelope 10.

A vertical partition 14 subdivides the primary lower area, conventionally known as the water box, into an admission manifold 16 and a discharge manifold 18 for the water flowing in the reactor primary circuit. Tubes 20, 22, welded to the outer envelope 10 of the steam generator, respectively connect the manifolds 16 and 18 to the primary circuit.

A bundle of inverted U-tubes 24 is tightly connected to the tube plate 12, in the upper secondary area defined by the latter, so that the two ends of each of the tubes respectively issue into the admission manifold 16 and into the discharge manifold 18. The vertical branches **24*a* of the tubes 24, which issue into the admission manifold 16, are referred to as hot branches and the vertical branches 24*b* of the tubes 24, which issue into the discharge manifold 18**, are referred to as cold branches.

The bundle of tubes 24 is surrounded and covered by an inner envelope 26 positioned coaxially in the outer envelope 10. The upper horizontal wall of the inner envelope 26 issues into steam/water separators 28 surmounted by dryers 29, which link the space 27 provided within the envelope 26 with a steam discharge tube 30 located at the top of the outer envelope 10. The lower edge of the inner envelope 26 is placed at a given distance above the tube plate 12, so as to form a passage between the annular recirculation space 32 defined between the envelopes 10, 26 and the space 27 defined in the inner envelope 26.

The secondary water supply to the steam generator takes place by a toroidal feed distributor 38 positioned immediately above the annular recirculation space 32. A feed tube 34 tightly traverses the outer envelope 10 of the steam generator and issues into the feed distributor 38. The latter can in particular be connected to the annular recirculation space 32 by inverted J-shaped tubes 36.

Horizontal flow distribution plates 40, which are regularly spaced, are fitted within the inner envelope 26. These plates have perforations making it possible to support the tubes 24 of the bundle over the entire height thereof and so as to bring about a maximum uniform radial distribution of the secondary water flow rising in the envelope 26.

The lower flow distribution plate 41 in FIG. 1 is positioned slightly above the lower edge of the inner envelope 26. It differs from the other plates 40 by the fact that it has a relatively large cross-section central opening 42. Thus, this lower plate 41 makes it possible to prevent secondary water descending through the annular recirculation space 32 from rising immediately after it has cleared the lower edge of the inner envelope 26, which would in particular lead to the creation above the central part of the tube plate 12 of a static zone.

According to the invention, a deflection and purging box 44 is fitted in the space 46, known as a water way, formed between the tube plate 12, the lower flow distribution plate 41 and the hot **24*a* and cold 24*b* branches of the tubes 24**.

Figure 4:
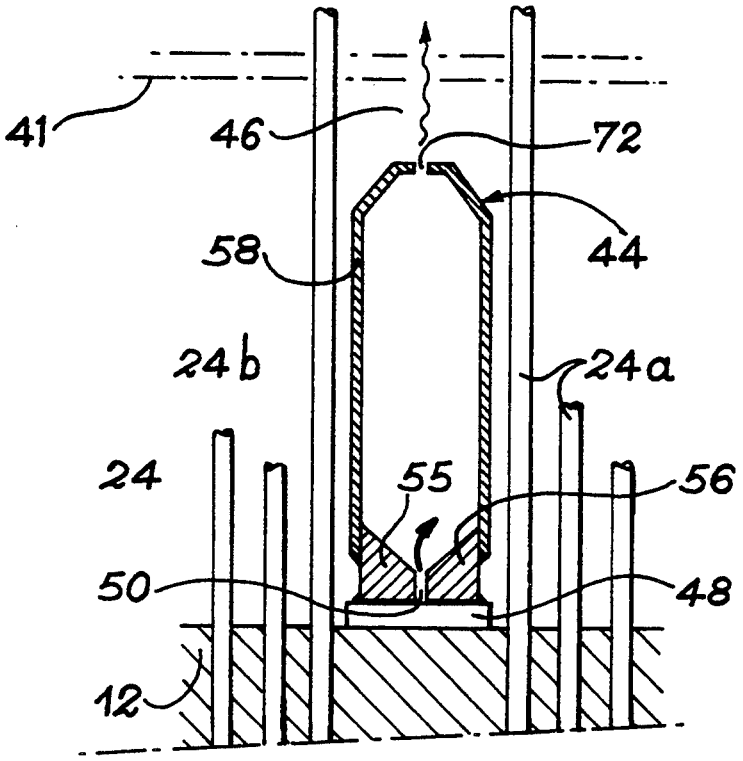
FIG. 4 is a sectional view along line IV—IV of FIG. 3.
Figure 2:
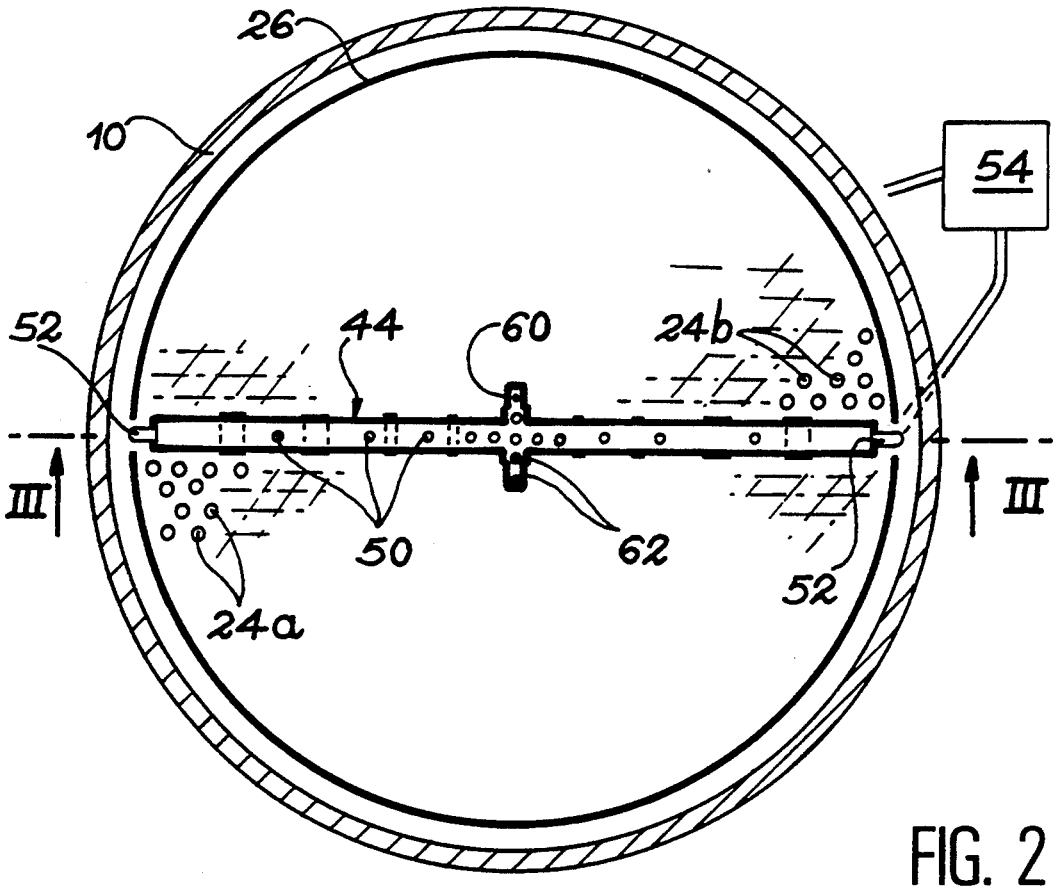
FIG. 2 is a larger scale, cross-sectional view along line II—II of FIG. 1.
Figure 3:
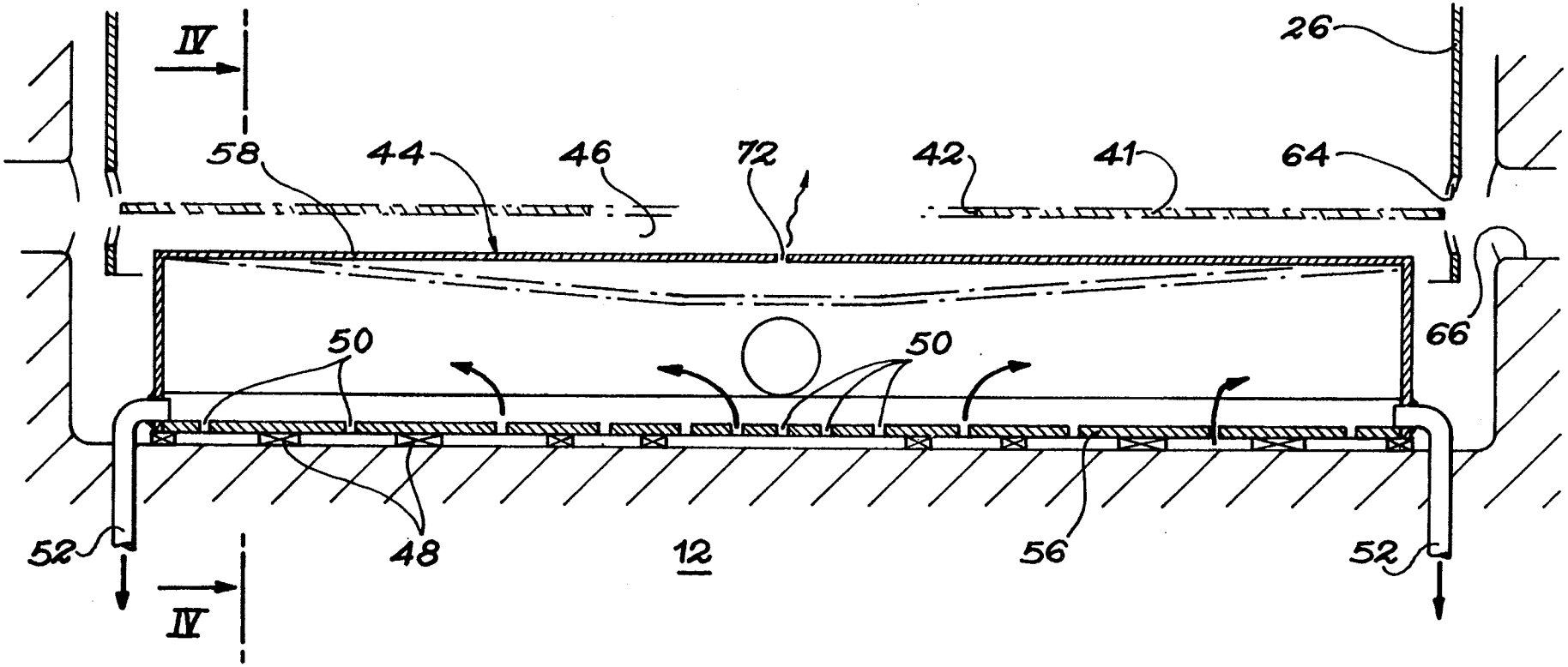
FIG. 3 is a larger scale sectional view along line III—III of FIG. 2.

As is more clearly illustrated by FIGS. 2 to 4, the deflection and purging box 44 extends horizontally and radially over the entire length of the space 46 up to the vicinity of the inner envelope 26. In the embodiment illustrated in FIGS. 1 to 4, which corresponds to a boiler-type steam generator, where there is no separation between the hot and cold branches of the tubes 24, the deflection and purging box 44 rests on the tube plate 12 via support members 48 ensuring a spacing between the bottom of the box and the upper face of the tube plate.

This spacing enables purging orifices 50 formed in the bottom of the box 44 to drain within the box the secondary fluid in the immediate vicinity of the tube plate 12 in the space 46. To this end, the purging orifices 50 issue between the support members 48. Advantageously they are also more numerous and/or have a larger cross-section in the central part of the steam generator than in the vicinity of the outer envelope 10, so as to favor drainage in the central part, in which the displacements of the secondary fluid are smaller.

Moreover, at least one vent (FIGS. 3 and 4) is formed on the top of the deflection box 44 in the central part of the steam generator. This vent ensures the penetration of secondary fluid in the box 44 when water is introduced into the steam generator.

As illustrated by FIGS. 3 and 4, the deflection and purging box 44 has a substantially rectangular cross-section and extends height-wise from the support members 48 to a level below that the lower flow distribution plate 41 above that of the lower edge of the inner envelope 26. Thus, the box 44 fulfils a deflecting function, i.e. it constitutes an obstacle opposing horizontal flow of tile secondary fluid transversely of the box. The deflection and purging box 44 thus fulfils the functions of rendering uniform the temperature of the secondary fluid before its rise in the space 27 and contributes to a good distribution of the flow rates of the fluid in the vicinity of the tube plate 12.

To this function, which is the same as that of prior art deflection or blocking devices, is added a purging function performed by means of purging orifices 50 and draining tubes 52 (FIG. 3) issuing into the bottom of the box 44 at each end thereof. Each of the drainage tubes 52 connects the box 44 to drainage means 54 located outside the steam generator and schematically illustrated in FIG. 2.

The drainage 54 make it possible to pump out of the steam generator a small amount of secondary fluid, in order to check its chemical concentrations in order to maintain them at an acceptable level and to remove or sample suspended materials which tend to be deposited in the space 46 on the tube plate 12.

In order to facilitate the flow of secondary fluid within the deflection and purging box 44 up to the drainage tubes 52, the bottom of the box 44 forms a horizontal recovery slot 55, in the bottom of which issue the purging orifices 50. The slot 55, e.g., as shown in FIG. 4, has a V-shaped cross-section. This shape can be obtained by machining the upper face of a rail 56 forming the bottom of the box 44 and by which the latter rests on the support members 48. The rest of the box 44 can be constituted by a plate 58 bent to form a U, whose ends are welded to the lateral faces of the rail 56. The ends of the box 44 are also formed by plates welded to the plate 58 and to the rail 56. The drainage tubes 52 are welded to the latter plates, so as to issue in the bottom of the V machined on the upper face of the rail 56.

It should be noted that this particular structure of the deflection and purging box 44 is shown by way of example and that numerous variations can be made to the shape and manufacturing method for the box without passing outside the scope of the invention.

Thus, the substantially rectangular cross-sectional shape of the box 44 in the embodiment shown can be replaced by a square, triangular or similar shape. Moreover, instead of having a constant cross-section in the manner illustrated in solid lines in FIG. 3, the box 44 can also have an evolutive cross-section in the manner illustrated e.g. in broken line form. This evolutive cross-section can in particular lead to a reduction of the height of the box in the central part of the steam generator compared with its height in the vicinity of the inner envelope 26. This leads to an improvement in the efficiency of the sampling of the secondary fluid taking place in the central part of the space 46.

Moreover, and as illustrated by Fig. 2, the sampling operations in the central part of the steam generator can be further improved by adding to the deflection and purging box 44 two purging tubes 60 connected to each of the lateral faces of the box 44 in the central part of the latter, and also having in the lower part purging orifices 62 turned towards the tube plate 12.

The geometry of the deflection and purging box 44 is also designed so as to take account of requirements linked with the maintenance operations which must be performable on the steam generator at the bottom of the tube bundle 24. Thus, as illustrated in FIG. 3, the upper wall of the box 44 is located substantially at the same level as the lower edge of the inspection holes 64 formed in the inner envelope 26 of the steam generator. These inspection holes 64 are themselves formed facing inspection holes 66 in the outer envelope 10 of the generator and normally sealed by plugs. As illustrated in FIG. 3, the inspection holes 64, 66 are located in the extension of the space 46, so as to give operator access between the hot and cold branches of the tubes 24 of the bundle.

Figure 5:
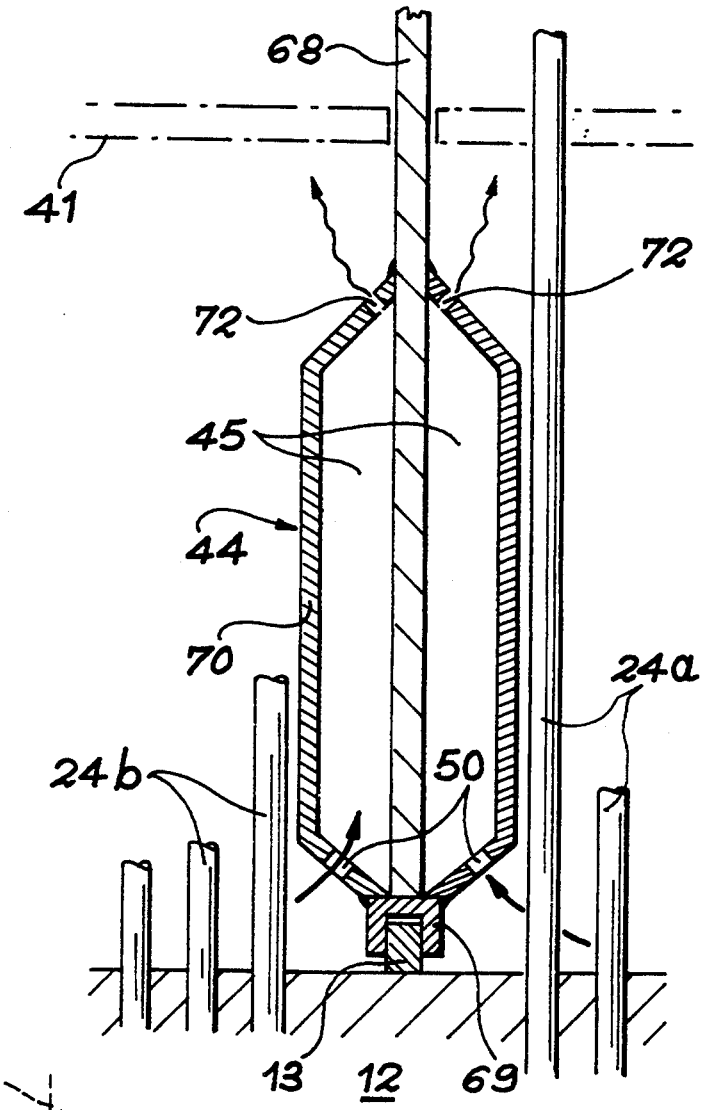
FIG. 5 is a sectional view comparable to FIG. 4 illustrating a second embodiment of the invention, in the case of an axial preheater-type steam generator.
Figure 6:
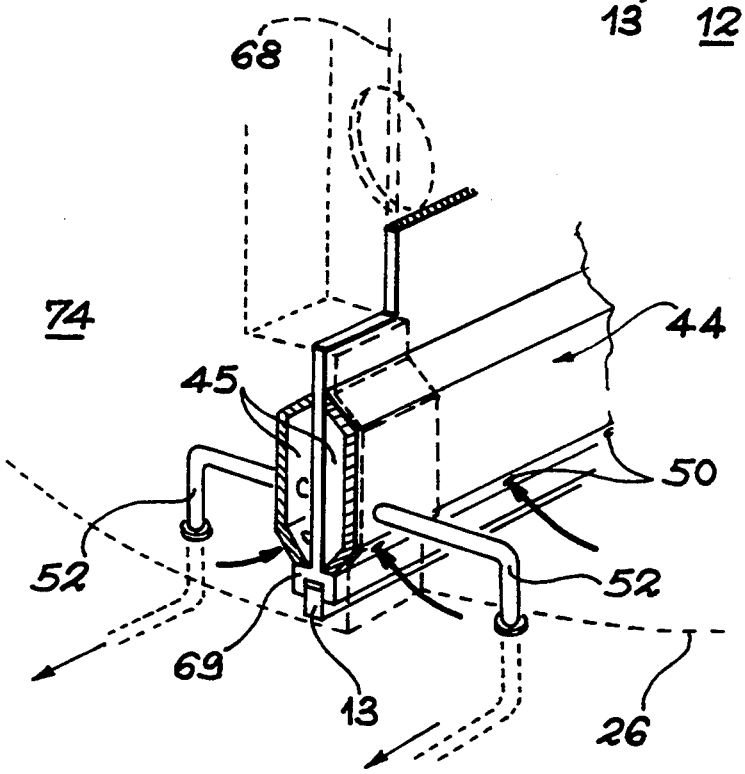
FIG. 6 is a perspective view showing the deflection and purging box illustrated in FIG. 5.

As illustrated in FIGS. 5 and 6, the invention is not limited to steam generators of the boiler type, but is also applicable to those of the axial preheater type, in which a vertical partition plate 68 is positioned between the hot and cold **24*a* branches of the tubes 24 and connected to the tube plate 12. This connection can in particular be ensured by fitting an inverted U-shaped profile 69 forming the lower edge of the partition plate 68 on a rib 13 welded or mechanically fixed to the upper face of the tube plate 12** in the axis of the waterway .

In this case, the deflection and purging box 44 has two compartments 45 on either side of the plate 68 and arranged symetrically with respect to the latter. As illustrated in FIGS. 5 and 6, these two compartments can be defined by two plates 70 bent and welded on either side of the plate 68.

Taking account of the separation of the two compartments 45 by the plate 68, each of them has in the bottom of the box 44 purging orifices 50, whose cross-section and/or number decreases from the center to the periphery of the steam generator. As illustrated by FIGS. 5 and 6, the bottom of each of the compartments 45 is inclined downwards on approaching the partition plate 68, in order to assist the drainage of the secondary fluid. Moreover, the top of each of the compartments 45 is inclined upwards on approaching the partition plate 68, so as to inwardly upwardly curve the secondary fluid flow.

As can be seen in FIG. 6, each of the compartments 45 of the deflection and purging box communicates with drainage means (not shown) positioned outside the steam generator by means of a separate drainage tube 52 at each of the ends of the box 44.

As in the first embodiment of the invention, the top of each of the compartments of the deflection and purging box 44 has, in the central part of the steam generator, at least one vent 72 (FIG. 5) ensuring the penetration of the secondary fluid into the box 44 by purging orifices 50 when water is introduced into the steam generator.

As shown in FIG. 6 in this case the steam generator has an intermediate semicylindrical envelope 74, which duplicates externally the internal envelope 26, in that part of the latter which surrounds the cold branches of the tubes 24. The feed distributor 38 of FIG. 1 then has a semicircular shape, so as to supply feedwater only to the space between the inner envelope 26 and the intermediate envelope 74. As is schematically illustrated in FIG. 6, the ends of the box 44 can then be sealed by the intermediate envelope 74.

In the embodiment illustrated in FIGS. 5 and 6, the deflection and purging box 44 fulfils the same function as in the first embodiment described and also has the same characteristics.

We claim:

1. Steam generator comprising a vertical outer envelope, a horizontal tube plate tightly fixed within the outer envelope, a bundle of inverted U-tubes having hot and cold branches with ends fixed to the tube plate and issuing below the tube plate, respectively in an inlet manifold and in a discharge manifold for the primary fluid, an inner envelope covering the tube bundle, whereof a lower edge is spaced from the tube plate and forms with the outer envelope an annular recirculation space, secondary water feed means issuing into the outer envelope above the tube plate, secondary steam extraction means through the top parts of the inner and outer envelope above the tube plate, secondary steam extraction means through the top parts of the inner and outer envelopes, a lower flow distribution plate located in a lower part of the inner envelope and comprising a central opening, and deflection and purging means located in a space formed between the tube plate, the lower flow distribution plate and the hot and cold branches of the tubes, wherein the deflection and purging means comprise at least one deflection and purging box extending over all or part of the length of said space up the vicinity of the inner envelope and extending heightwise to the vicinity of the lower edge of the inner envelope, said at least one box being spaced from the tube plate and having purging orifices facing the latter.

2. Steam generator according to claim 1, wherein the deflection and purging box extends heightwise up to an intermediate level between the lower flow distribution plate and the lower edge of the inner envelope.

3. Steam generator according to claim 2, wherein inspection holes formed in the inner envelope and in the outer envelope issue immediately above the longitudinal ends of the deflection and purging box.

4. Steam generator according to claim 1, wherein the deflection and purging means comprise drainage means linked with the deflection and purging box by at least one drainage tube issuing at at least one end of the box.

5. Steam generator according to claim 1, wherein the deflection and purging means also comprise at least two purging tubes issuing laterally into a central part of the deflection and purging box on either side of the latter and having other purging orifices facing the tube plate.

6. Steam generator according to claim 1, wherein the deflection and purging box has a bottom forming a longitudinal recovery slot into which issue the purging orifices.

7. Steam generator according to claim 1, wherein the deflection and purging box has a uniform cross-section over its entire length.

8. Steam generator according to claim 1, wherein the deflection and purging box has an evolutive cross-section.

9. Steam generator according to claim 1, wherein the deflection and purging box rests on the tube plate by means of support members between which are formed purging orifices.

10. Steam generator according to claim 1, wherein the hot and cold branches of the tubes of the bundle are separated by a vertical partition plate connected to the tube plate, the deflection and purging box having two parts on either side of said partition plate and supported by the partition plate.

* * * * *